US009997149B2

(12) United States Patent
Trifilio

(10) Patent No.: US 9,997,149 B2
(45) **Date of Patent: *Jun. 12, 2018**

(54) ADJUSTABLE GUITAR EFFECTS PEDALBOARD

(71) Applicant: Chemistry Design Werks LLC, St. Paul, MN (US)

(72) Inventor: Christian Richard Trifilio, St. Paul, MN (US)

(73) Assignee: Chemistry Design Werks LLC, St. Paul, MN (US)

( * ) Notice: Subject to any disclaimer, the term of this patent is extended or adjusted under 35 U.S.C. 154(b) by 41 days.

This patent is subject to a terminal disclaimer.

(21) Appl. No.: 15/590,716

(22) Filed: May 9, 2017

(65) Prior Publication Data

US 2017/0243572 A1 Aug. 24, 2017

Related U.S. Application Data

(63) Continuation-in-part of application No. 15/231,314, filed on Aug. 8, 2016, now Pat. No. 9,691,369, which is a continuation-in-part of application No. 29/540,570, filed on Oct. 5, 2015, now Pat. No. Des. 769,364.

(60) Provisional application No. 62/248,589, filed on Oct. 30, 2015.

(51) Int. Cl.
*G10G 5/00* (2006.01)
*G10H 1/34* (2006.01)

(52) U.S. Cl.
CPC ..... *G10H 1/348* (2013.01); *G10G 5/00* (2013.01); *G10H 1/342* (2013.01); *G10H 2210/155* (2013.01)

(58) Field of Classification Search
CPC ..... G10D 5/00; G10G 7/00; G10G 7/005
See application file for complete search history.

(56) References Cited

U.S. PATENT DOCUMENTS

| | | | |
|---|---|---|---|
| D311,458 | S | 10/1990 | La Croix |
| 6,459,023 | B1 | 10/2002 | Chandler |
| 6,538,185 | B1 | 3/2003 | Stratton |
| D594,564 | S | 6/2009 | Disch et al. |

(Continued)

OTHER PUBLICATIONS

"My New Pedalboard," Posted at musiciansroadhouse.com, earliest date available Dec. 1, 2015, [online], acquired on Jul. 1, 2016. Available from Internet, <URL: http://musiciansroadhouse.com/viewtopic.php?t=4562&start=300>.

(Continued)

*Primary Examiner* — Kimberly Lockett
(74) *Attorney, Agent, or Firm* — Grumbles Law PLLC; Brittany Nanzig; Paul Feng

(57) ABSTRACT

An adjustable guitar effects pedalboard for anchoring guitar effects pedals. More specifically, a pedalboard having at least two telescoping sections, wherein the pedalboard is configured to allow users to adjust the width of the pedalboard to fit their needs. The pedalboard can have an upper level and a lower, telescoping level, and the upper level and the lower, telescoping level may be curved and further contain a plurality of holes on which users can use cable ties to anchor their guitar effects pedals. The plurality of holes in each of the at least two telescoping sections may align with each other in various positions of expansion and contraction.

20 Claims, 18 Drawing Sheets

(56) References Cited

U.S. PATENT DOCUMENTS

| | | | | |
|---|---|---|---|---|
| D690,708 | S | 10/2013 | Smith et al. | |
| D745,923 | S | 12/2015 | Trifilio | |
| D745,924 | S | 12/2015 | Trifilio | |
| 9,691,369 | B2 * | 6/2017 | Trifilio | G10H 1/348 |
| 2003/0230220 | A1 | 12/2003 | Evans et al. | |
| 2004/0250673 | A1 | 12/2004 | Salerno | |
| 2006/0120550 | A1 | 6/2006 | McCann | |
| 2007/0295190 | A1 | 12/2007 | Collins | |
| 2011/0271821 | A1 | 11/2011 | McKinney et al. | |

OTHER PUBLICATIONS

"Chemistry Design Werks Holeyboard WIDE Review—Best Guitar Pedalboard?," posted at bestguitareffects.com, earliest date available Aug. 23, 2013, [online], acquired on Jul. 1, 2016. Available from Internet, <URL: http://www.bestguitareffects.com/chemistry-design-werks-holeyboard-wide-review-best-guitar-pedalboard>.

Pedaltrain; Pedal Boards—Pedaltrain; Website; Jul. 27, 2014; http://www.pedaltrain.com/pedalboards.

Trailer Trash Pedalboards; Trailer Trash Pedal Boards: Custom Pedalboards; Website; Feb. 7, 2005; http://trailertrashpedalboards.com.

Rogue Guitar Shop; Pedalboards—Rogue Guitar Shop; Website; Oct. 10, 2014; http://www.rogueguitarshop.com/collections/pedalboards.

Gator Cases, Inc.; Pedal Boards and Stands; Website; Mar. 3, 2012; http://www.gatorcases.com/c/16108/pedal-boards-and-stands.

Blackbird; Blackbird Custom Pedalboards; Website; May 19, 2013; http://blackbirdpedalboards.com.

FIX Pedal Boards; Welcome to FIX Pedalboards; Website; Apr. 21, 2013; http://blackbirdpedalboards.com.

MKS Professional Stage Products, Inc; Pedal Pad Get Serious; Webiste; Apr. 29, 2013; http://www.pedalpad.com.

Phantom Pedalboards; Phantom Pedalboards; Website: Apr. 1, 2015; http://www.phantompedalboards.com/boards/index.

SKB Corporation; Guitar Products; Website: Jun. 3, 2014; https://www.skbcases.com/music/products/prodlist.php?c=85&s=75.

Renovo Amp Works; Stombox Modular Pedalboards; Website; Jan. 22, 2015; http://www.stompblox.com.

Diago; Diago Hardcase Pedalboards; Website; Apr. 23, 2012; http://www.diago.co.uk/pedalboards/diago-pedalboards.html.

LYT Pedalboards; LYT Pedalboards; Website; Jan. 1, 2012; http://www.lytpedalboards.com.

Llevinac SL; Adam Guitars; Website; 2015; http://www.aclamguitars.cat/shop/en/landing-page/81-2014guitar.html.

U.S. Appl. No. 29/540,570, filed May 10, 2015.

U.S. Appl. No. 62/248,589, filed Oct. 30, 2015.

Prosecution History from U.S. Appl. No. 29/540,570, dated Jul. 28, 2016 through Jul. 29, 2016, 11 pp.

U.S. Appl. No. 15/231,314, filed Aug. 8, 2016.

* cited by examiner

FIG. 4
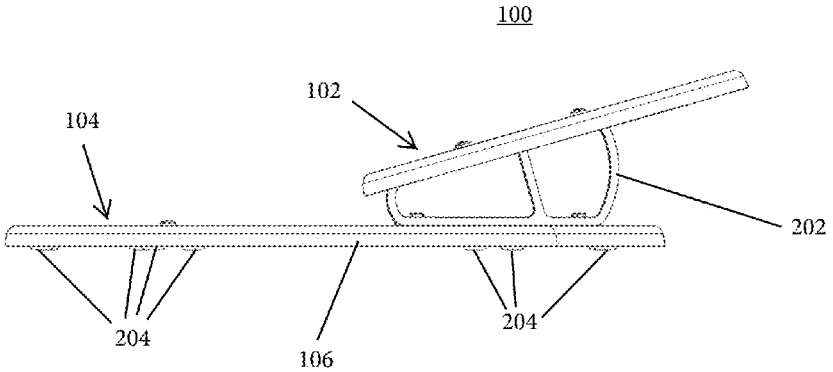
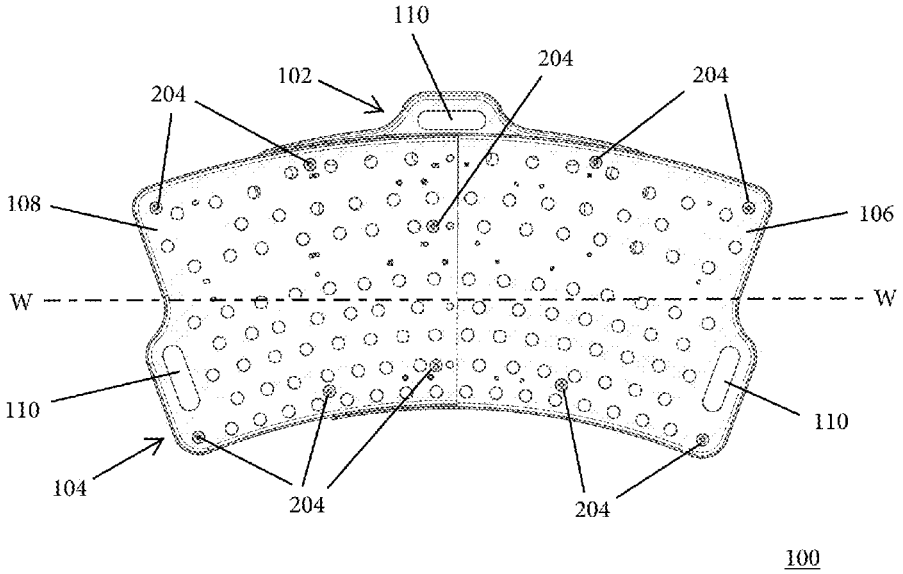
FIG. 5

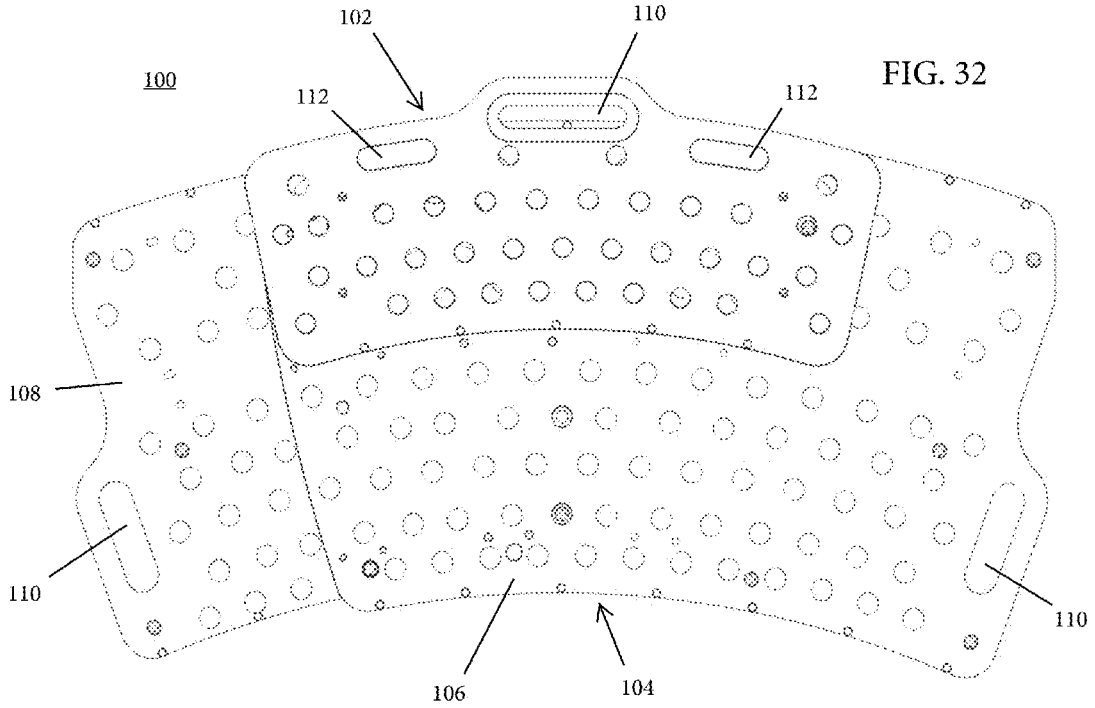
FIG. 32
FIG. 33
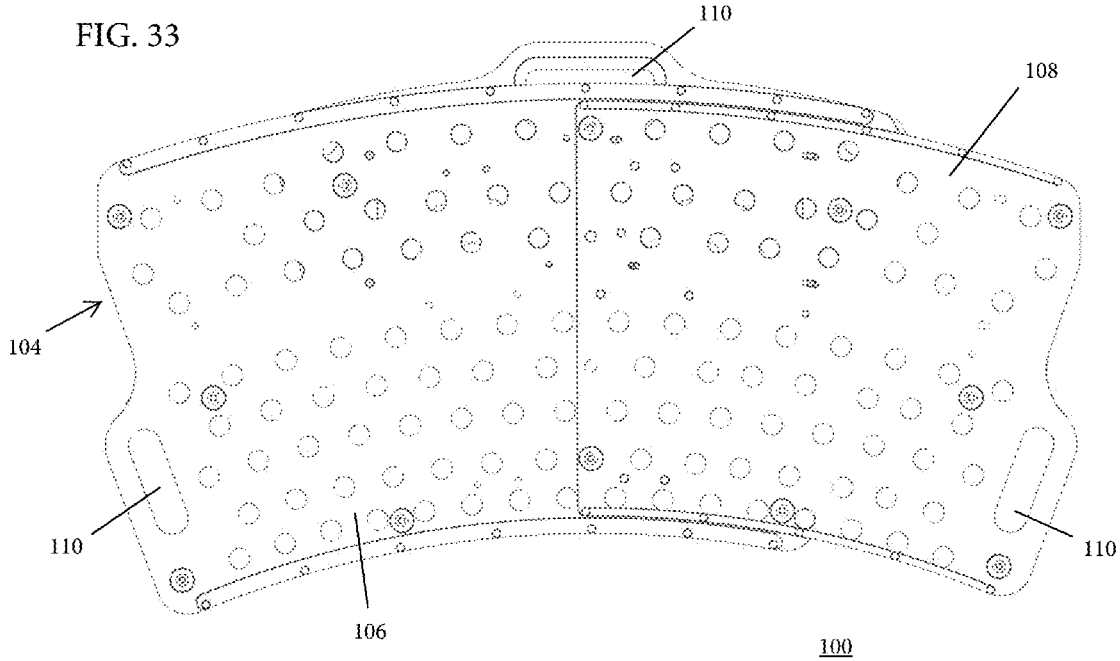

ADJUSTABLE GUITAR EFFECTS PEDALBOARD

CROSS-REFERENCE TO RELATED APPLICATIONS

The disclosed application is a continuation in part of U.S. application Ser. No. 15/231,314, filed Aug. 8, 2016, titled ADJUSTABLE GUITAR EFFECTS PEDALBOARD, which is a continuation in part of U.S. application Ser. No. 29/540,570, filed Oct. 5, 2015, titled ADJUSTABLE GUITAR PEDALBOARD and which claims the benefit of U.S. Provisional Application No. 62/248,589, filed on Oct. 30, 2015, titled ADJUSTABLE GUITAR EFFECTS PEDALBOARD.

FIELD OF THE DISCLOSURE

The disclosed invention relates to an adjustable guitar effects pedalboard. More specifically, the disclosed invention relates to a curved pedalboard having telescoping sections that enable users to adjust the width of the pedalboard to fit their needs. The pedalboard further contains holes on which a user can anchor guitar effects pedals.

BACKGROUND OF THE INVENTION

When playing concerts, musicians often use effects units to alter how a musical instrument sounds. Some units are built into an instrument while others are separate from the instrument. For example, guitar players will often use guitar effects pedals to alter the sound of their electric guitars. While guitar effects pedals provide a musician with additional sounds, they are usually limited to one or two effects. Therefore, guitar players frequently desire access to a plurality of guitar effects pedals during a concert. However, placement of several pedals loose on a performance floor is impractical and can pose risk of damage to, or disconnection of, the various pedals during performance.

To meet the need for convenient use of multiple pedals, a pedalboard is often used. Often times, pedalboards are flat boards to which a user can attach guitar effects pedals through the use of hook and loop fasteners (for example, Velcro). For example, a user can attach the hook side to the pedalboard and the loop side to the guitar effects pedal, or vice versa. This enables a guitar effects pedal to be removed if it is not in use. However, pedals are frequently different sizes, and hook and loop fasteners often leave residue if removed from the pedalboard or guitar effects pedals. Therefore, if a guitar player uses hook and loop fasteners to attach pedals to a pedalboard, it can be difficult to rearrange the layout of pedals.

To overcome this design shortfall, pedalboards have been created that have holes in them. By using a pedalboard with holes, a user can thread a cable tie through two holes and secure the pedal to the pedalboard. Because a cable tie can easily be removed by being cut, and because the cable tie will not leave residue on the pedalboard, this type of pedalboard enables a user to easily re-arrange the pedals whenever the user desires. However, one problem that continues to exist is the fixed size of the pedalboard. A guitar player who is a relative novice may want a small pedalboard that holds only a few guitar effects pedals, but may quickly gain skill and desire additional effects pedals. Consequently, the guitar player may need a larger pedalboard. Therefore, that user must purchase another pedalboard. In another example, a user may play different kinds of concerts or different styles of music, wherein several effects pedals are required at some concerts but only a few are required at others. Because of the fixed size of pedalboards, the user must purchase several pedalboards to meet his or her needs. Therefore, a pedalboard is needed that a user can vary in size based on the user's particular performance needs.

SUMMARY OF THE INVENTION

The present disclosure relates to an adjustable guitar effects pedalboard having telescoping sections that enable users to adjust the width of the pedalboard to fit their needs. Additionally, the pedalboard can have an upper level located above the telescoping sections. The telescoping sections, the upper level, and combinations thereof can further contain holes on which users can anchor their guitar pedals. More specifically, the holes in the telescoping sections can line up when the telescoping sections are in various positions of expansion and contraction. In some variations, the telescoping sections, the upper level, and combinations thereof are at least slightly curved, and expansion of the telescoping sections occurs on an arc.

BRIEF DESCRIPTION OF THE DRAWINGS

FIG. 4 is a right side elevational view of the adjustable guitar effects pedalboard of FIG. 1 in a partially expanded configuration according to one embodiment of the disclosed device.

FIG. 5 is a bottom view of the adjustable guitar effects pedalboard of FIG. 1 in a partially expanded configuration according to one embodiment of the disclosed device.

FIG. 32 is a top view of an adjustable guitar effects pedalboard in a partially expanded configuration according to one embodiment of the disclosed device.

FIG. 33 is a bottom view of the adjustable guitar effects pedalboard of FIG. 32 in a partially expanded configuration according to one embodiment of the disclosed device.

DETAILED DESCRIPTION

Figure 1:
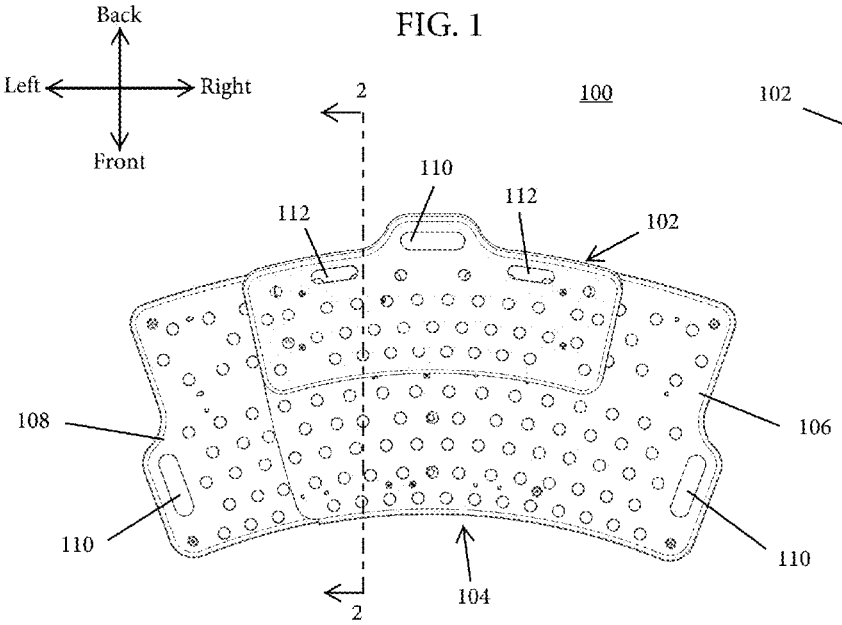
FIG. 1 is a top view of an adjustable guitar effects pedalboard in a partially expanded configuration according to one embodiment of the disclosed device.

The present disclosure relates to an adjustable guitar effects pedalboard 100 that is used as a platform to which a user can attach guitar effects pedals. Various embodiments of the pedalboard 100 will be described in detail with reference to the drawings, wherein like reference numerals represent like parts and assemblies throughout the several views. Reference to various embodiments does not limit the scope of the pedalboard 100 disclosed herein. Additionally, any examples set forth in this specification are not intended to be limiting and merely set forth some of the many possible embodiments for the pedalboard 100. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

In general terms, the present disclosure relates to an adjustable guitar effects pedalboard 100 used as a platform to which a user can attach guitar effects pedals. Various embodiments of the pedalboard 100 can include a number of components including, but not limited to, an upper level 102 having a plurality of holes and a substantially flat, top mounting surface; a lower, telescoping level 104 comprised of at least two telescoping sections and having a plurality of holes and a substantially flat, top mounting surface; and at least one riser 202 to lift and secure the upper level 102 over the lower level 104. The pedalboard 100 can be approximately 5½ inches tall from the ground to the top of the pedalboard 100, 17 inches long from the front to the back of the pedalboard 100, and each of the levels can be approximately one half of an inch thick. As described further below, the width of the pedalboard 100 may be variable. Additionally, the pedalboard 100 can be made of aluminum, wood, plastic, or any other metal. For example, the upper level 102 and the lower level 104 may be made of aluminum that is 100 to 125 thousandths thick. The plurality of holes in the upper level 102 and the lower level 104 can be circular, as illustrated in FIGS. 1, 5, 19-20, and 32-33 or any other shape. In some embodiments, some of the holes can be oblong and can be configured to operate as handles 110.

Figure 18:
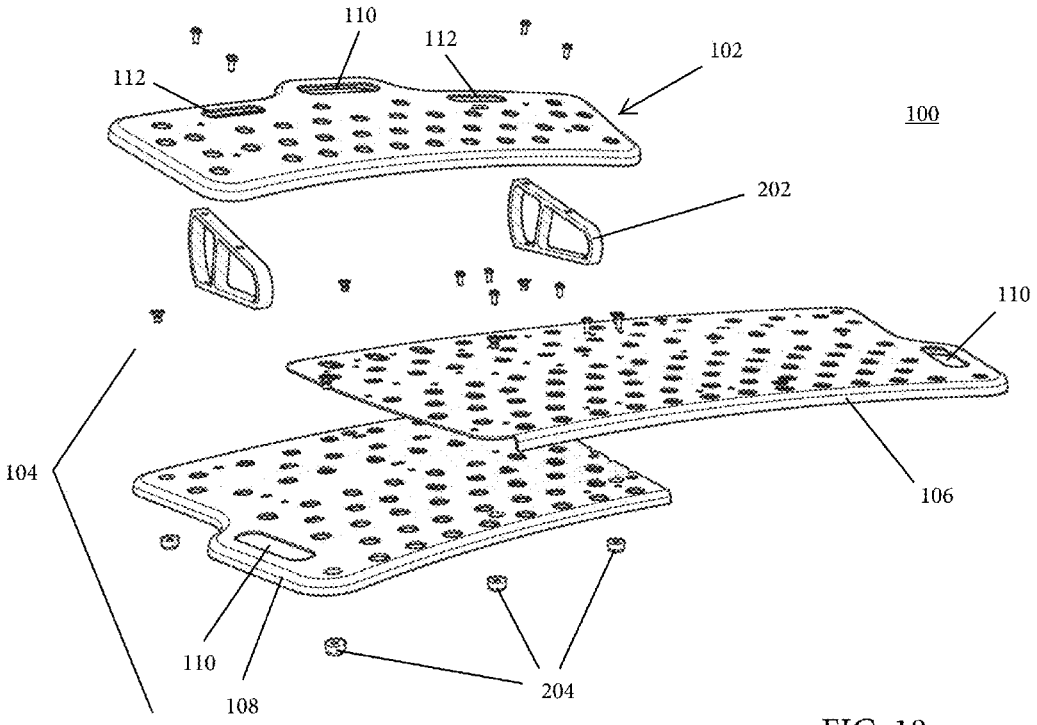
FIG. 18 is an exploded view of an adjustable guitar effects pedalboard according to one embodiment of the disclosed device.

As illustrated in FIG. 18, each of the two components of the lower level 104 has holes throughout the surface through which a user can thread, for example, a cable tie, rubber band, twist tie, or other securing means to secure a guitar effects pedal to the pedalboard 100. More specifically, a user can place a portion or the entirety of a guitar effects pedal between two holes on the pedalboard 100, thread a cable tie through the two holes and around the pedal or a portion thereof, and secure the cable tie to itself with the pedal or a portion thereof now held firmly in place between the pedalboard 100 and the cable tie. The same process can be implemented on the upper level 102.

Effects pedals do not come in standard sizes and some tend to be much bigger or much smaller than others. When attaching an effects pedal to a pedalboard 100 with holes, it is important for the holes to be located at close locations to, and in various positions around, the effects pedals. The holes on the upper level 102 and lower level 104 are specifically designed for several industry effects pedal types. Additionally, the upper level 102, in some embodiments, can support other guitar accessories attached to the pedalboard 100. Because of the pattern of holes disclosed herein, virtually any pedal can be attached securely to the pedalboard 100.

Figure 19:
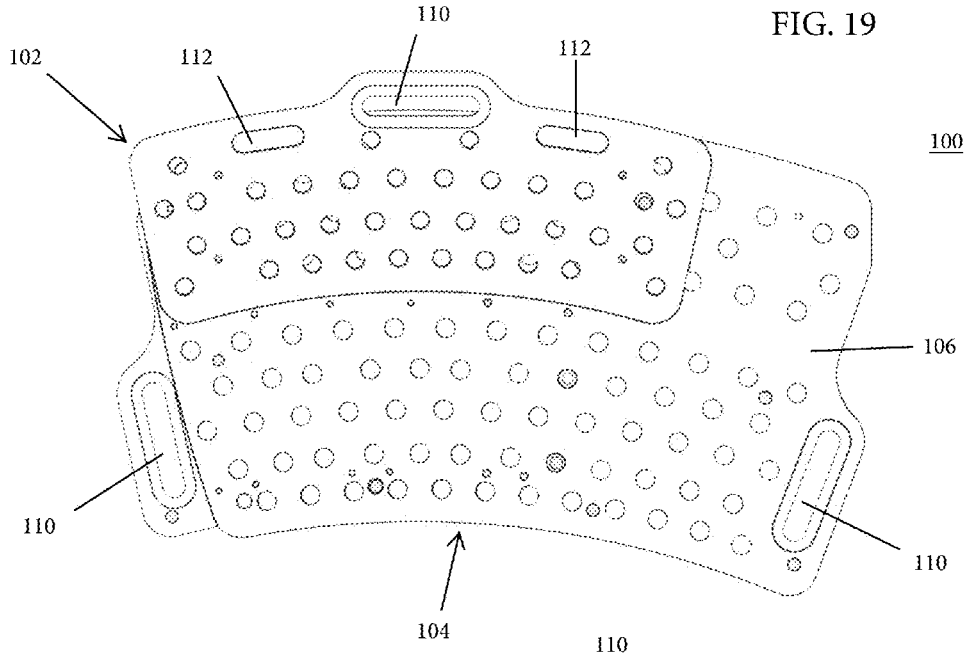
FIG. 19 is a top view of an adjustable guitar effects pedalboard in a closed configuration according to one embodiment of the disclosed device.

In a preferred embodiment, the upper level 102 is smaller in width and length than the lower level 104 and is located above the top face near the back edge, or mounting surface, of the lower level 104, as illustrated in FIGS. 1, 19, and 32. However, the upper level 102 can be as wide and/or as long as the lower level 104 and may be fixed in its position or may be adjustable and/or removable so that it can attach in various places along the lower level 104. For example, the upper level 102 can be adjustably located above the top face of the lower level 104 near the back edge and on the left, middle, or right sides of the top face of the lower level 104, as illustrated in FIGS. 8-17, 23-31, and 37. In other embodiments, the upper level 102 can be located above the top face of the lower level 104 near its middle or toward the front edge near the left, middle, or right sides of the top face of the lower level 104. In a preferred embodiment, the width of the upper level 102 is fixed. However, in some embodiments the upper level 102 may be comprised of telescoping sections and, therefore, may vary in width.

To connect the upper level 102 and the lower level 104 together, at least one riser 202 can be used. As mentioned above, in some embodiments, the riser 202 can attach to the bottom face of the upper level 102 and the top face of the lower level 104 to provide a user with two levels of pedalboard options. Generally, the riser 202 is not limited to any particular shape or configuration provided it enables the upper level 102 to separate from the lower level 104. Further, the riser 202 can move with the upper level 102 when a user decides to expand or contract the lower level 104, the process of which is described in more detail below.

Figure 6:
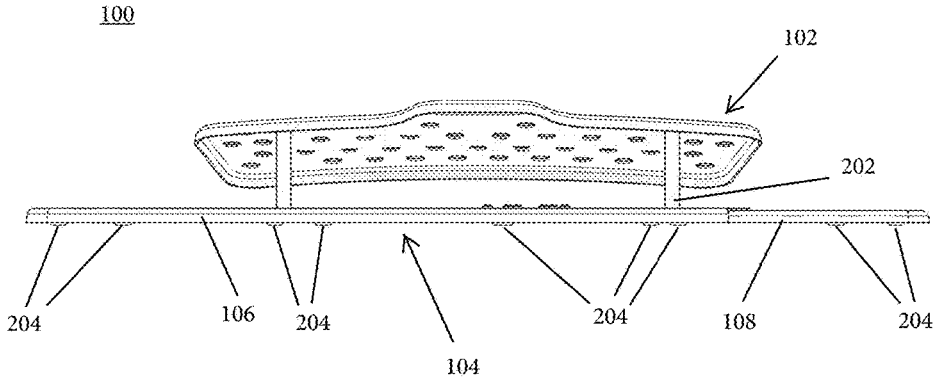
FIG. 6 is a back elevational view of the adjustable guitar effects pedalboard of FIG. 1 in a partially expanded configuration according to one embodiment of the disclosed device.
Figure 7:
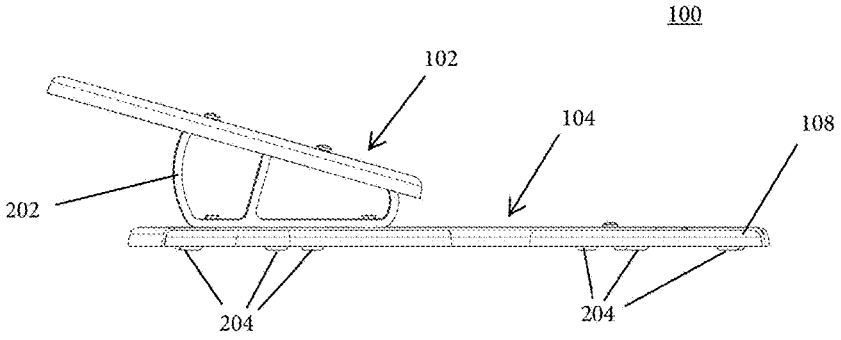
FIG. 7 is a left side elevational view of the adjustable guitar effects pedalboard of FIG. 1 in a partially expanded configuration according to one embodiment of the disclosed device.
Figure 9:
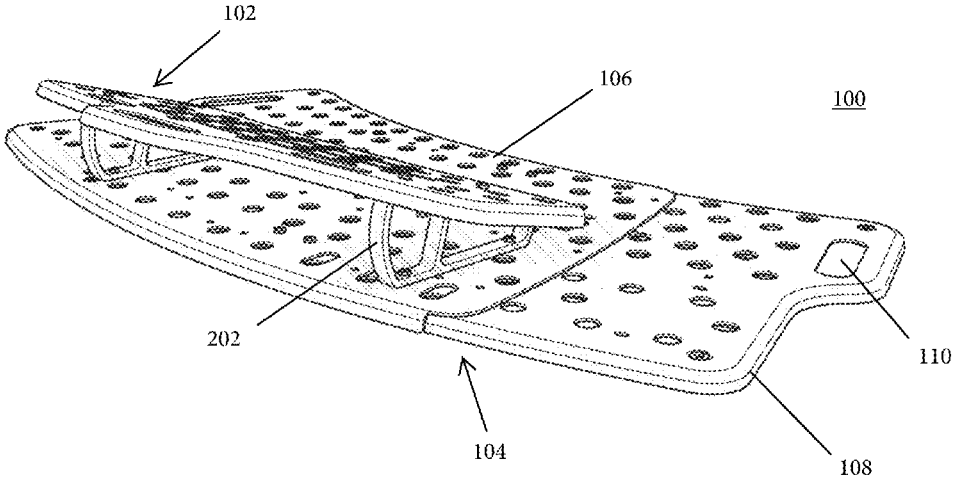
FIG. 9 is a back left side perspective view of the adjustable guitar effects pedalboard of FIG. 1 in a partially expanded configuration according to one embodiment of the disclosed device.
Figure 35:
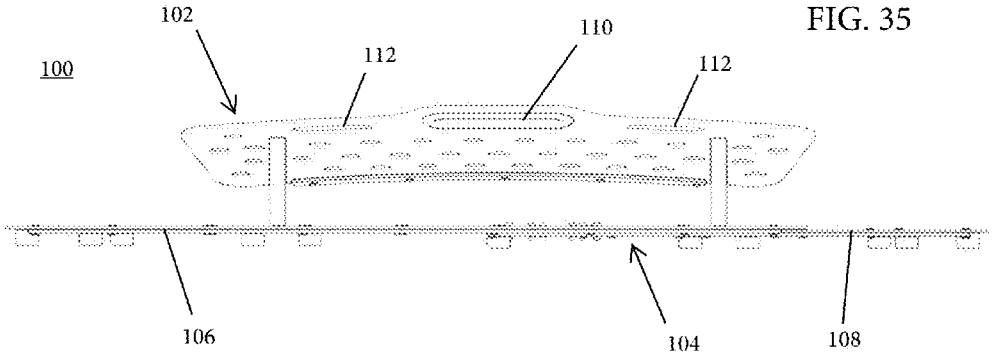
FIG. 35 is a back elevational view of the adjustable guitar effects pedalboard of FIG. 32 in a partially expanded configuration according to one embodiment of the disclosed device.
Figure 36:
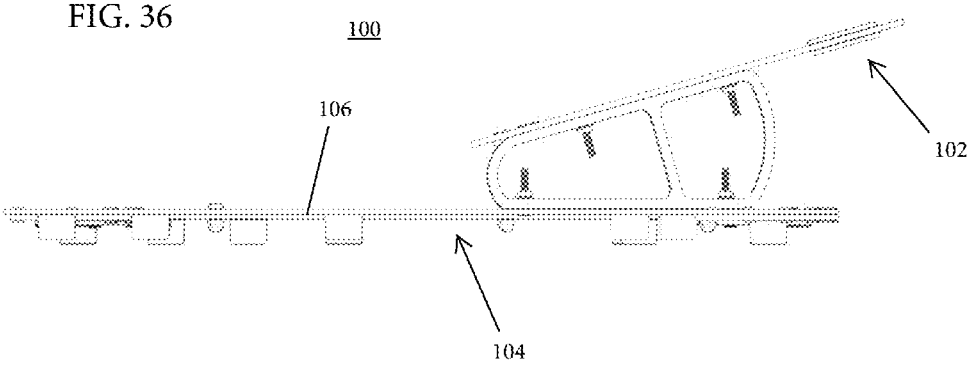
FIG. 36 is a right side elevational view of the adjustable guitar effects pedalboard of FIG. 32 in a partially expanded configuration according to one embodiment of the disclosed device.

In some embodiments, the pedalboard 100 contains a plurality of risers 202. For example, one riser 202 may be on the left side of the bottom face of the upper level 102 and one may be on the right side of the bottom face of the upper level 102, as illustrated in FIGS. 6, 9, and 35. However, any number of risers 202 can be used to lift and secure the upper level 102 on the top face of the lower level 104. For example, risers 202 may be located on the bottom face of the upper level 102 near its right side, left side, front side, back side, or any combination thereof.

In another embodiment, the riser 202 may be an extension of the upper level 102, the lower level 104, or both. More specifically, the back edge of the lower level 104, or a portion of the back edge of the lower level 104, may extend further out and connect to or merge with an extension of the back edge of the upper level 102, or a portion of the back edge of the upper level 102. This may be the case with the left edge, the right edge, the front edge, or combinations thereof.

Generally, the riser 202 may have one end attached to any portion of the lower level 104 such as, but not limited to, the bottom face, top face, or any edge, and it may have a second end attached to any portion of the upper level 102 such as, but not limited to, the bottom face, top face, or any edge. For example, the riser 202 may connect to and wrap around from the bottom face of the lower level 104 to connect to and wrap around to the top face of the upper level 102. In a similar example, there may be two risers 202, wherein a first riser 202 attaches along the left sides of the upper level 102 and lower level 104 and a second riser 202 attaches along the rights sides of the upper level 102 and lower level 104.

In some embodiments, the riser 202 is adjustable. For example, the riser 202 may be collapsible and expandable, which may enable a user to shift the upper level 102 up and down, backwards and forwards, or combinations thereof. In another example, the riser 202 may be a post, which may enable a user to spin the upper level 102 around a central point. In yet another example, the riser 202 may slide along a track located on the upper face of the lower level 104, which may enable a user to shift the upper level 102 left and right without needed to detach the upper level 102 from the lower level 104. Other variations of an adjustable riser 202 are possible and the disclosed riser 202 is not limited to the variations described herein.

Figure 3:
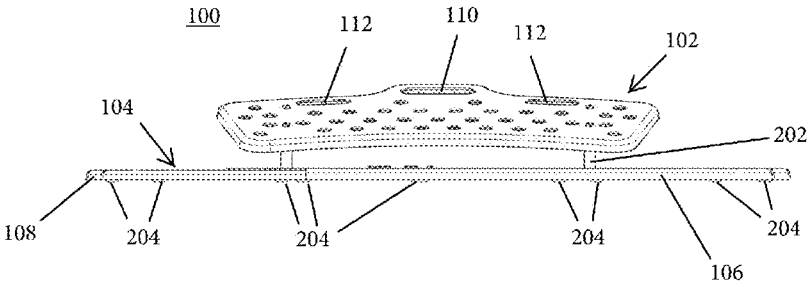
FIG. 3 is a front elevational view of the adjustable guitar effects pedalboard of FIG. 1 in a partially expanded configuration according to one embodiment of the disclosed device.
Figure 21:
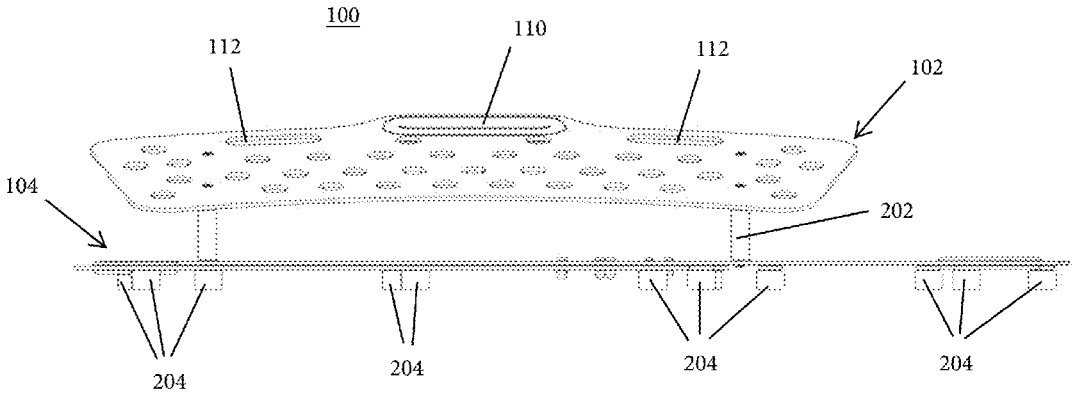
FIG. 21 is a front elevational view of the adjustable guitar effects pedalboard of FIG. 19 in a closed configuration according to one embodiment of the disclosed device.
Figure 34:
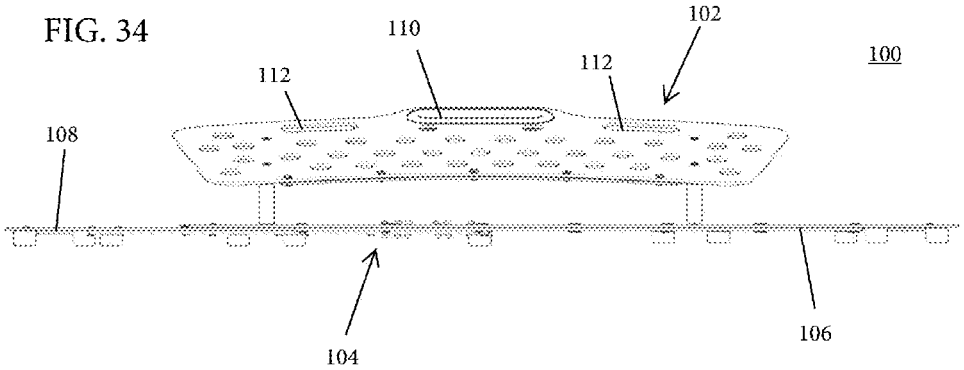
FIG. 34 is a front elevational view of the adjustable guitar effects pedalboard of FIG. 32 in a partially expanded configuration according to one embodiment of the disclosed device.

In a preferred embodiment, two risers 202 lift the upper level 102 high enough off of the lower level 104 to allow effects pedals to fit underneath the upper level 102 on the portion of the lower level 104 situated underneath the upper level 102. The risers 202 can have a uniform height or they can be shorter in the front and taller in the back, as illustrated in FIGS. 4, 7, 22, and 36. By having the back of the risers 202 taller than the front, the lower level 104 tilts toward the user at an angle, as illustrated in FIGS. 3, 21, and 34, and permits a user to more effectively reach an effects pedal or an amp that is attached to the upper level 102. In some embodiments, the risers 202 are made of aluminum. However, they can be made of any solid material such as, but not limited to, wood, plastic, or any other metals.

Figure 20:
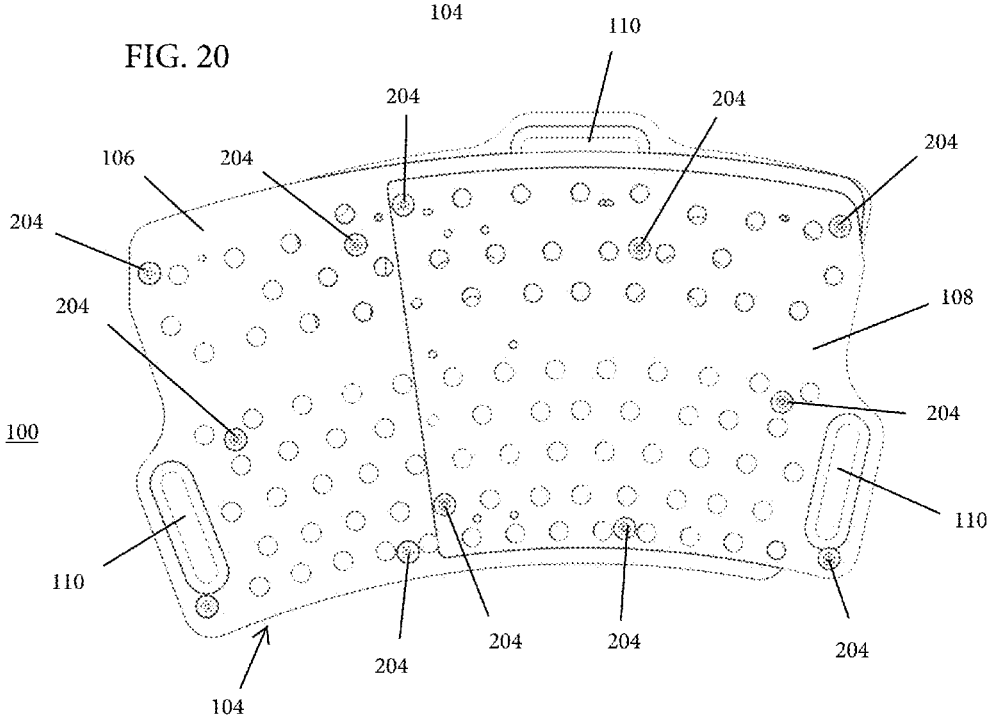
FIG. 20 is a bottom view of the adjustable guitar effects pedalboard of FIG. 19 in a closed configuration according to one embodiment of the disclosed device.

In some embodiments, the main pieces or telescoping sections of the lower level 104 can contain feet 204 to hold the pedalboard 100 off of the ground and prevent the pedalboard 100 from slipping on smooth surfaces. Additionally, the extra space beneath the pedalboard 100 can be used to keep the pedalboard 100 stable and flat when cords and cable ties or other securing features are wrapped or routed underneath the pedalboard 100. As illustrated in FIGS. 5, 20, and 33, the feet 204 can be dispersed throughout the bottom face of the lower level 104.

The feet 204 can be made of an elastomer such as natural rubber, a silicone rubber, or any other type of elastomeric compound. Alternatively, the feet 204 can be made of wood, plastic, or metal and can have attachments on their bottoms, such as elastomeric pads, that provide a stronger friction coefficient.

Figure 2:
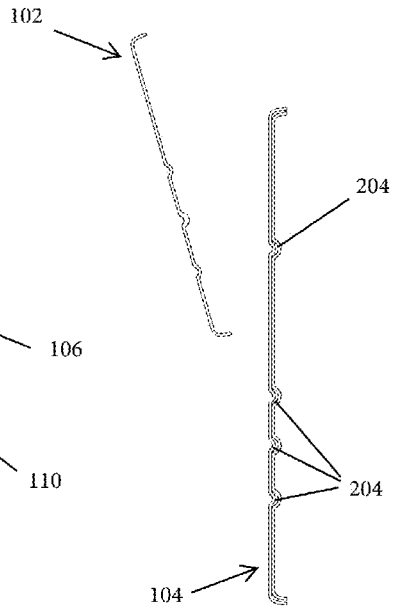
FIG. 2 is a right side cross-sectional view of the adjustable guitar effects pedalboard of FIG. 1 taken from the line 2-2 in FIG. 1.

In one embodiment, the feet 204 are independent pieces that are separate from and attached to the bottom face of the telescoping sections of the lower level 104. They can be structured as posts, risers, bumpers (such as, but not limited to, rubber bumpers), wedges, footpads, or any other structure that lifts a surface off the ground. In another embodiment, the feet 204 may be incorporated into the lower level 104 of the pedalboard 100, as illustrated in FIG. 2. For example, if a mold is used to form the lower level 104, the mold can incorporate the feet 204 so that when the material is poured into the mold, the feet 204 are a plurality of continuous extensions of the lower level 104.

Similarly, the feet 204 may be an extension from an edge of the telescoping sections of the lower level 104 or a portion of the bottom face near the edge of the telescoping sections of the lower level 104. For example, the back edge of the lower level 104 may extend out, down, and then forward and underneath the telescoping sections so that the back portion of the lower level 104 is lifted up. Additionally, the front edge of the lower level 104 may extend out, down, and then backward and underneath the telescoping sections so that the front portion of the lower level 104 is lifted up. In another example, the left and right sides of the lower level 104 may extend out, down, and then in and underneath the telescoping sections so that the remainder of the pedalboard 100 is lifted up off of the ground.

In an alternative embodiment, the feet 204, or the portion of the feet 204, toward the back of the pedalboard 100 may be taller than the feet 204, or the portion of the feet 204, toward the front of the pedalboard 100. Alternatively, the feet 204 may be adjustable in height so a user can adjust each foot 204 and/or each portion of a foot 204 according to the user's wishes. For example, a foot 204 may be a riser that runs along the bottom face of the lower level 104 from front to back and the back portion of the foot 204 may be capable of adjusting to have a taller height than the front portion of the foot 204. The ability to adjust each foot 204 enables a user to tilt the pedalboard 100 forward, which makes it easier for a user to reach the pedals attached to the top faces of the pedalboard 100.

In some embodiments, instead of, or in addition to, feet 204, the pedalboard 100 can have a kickstand located underneath the lower level 104. The kickstand can lift the entire pedalboard 100 up uniformly, or it can enable the lower level 104 to tilt at an angle toward the user. The kickstand can also be adjustable to various heights.

In a preferred embodiment, the lower level 104 of the pedalboard 100 is comprised of at least two components or telescoping sections that are slidably connected to create the telescoping feature, therefore enabling the width, illustrated along line W-W in FIG. 5, of the lower level 104 to vary. More specifically, each of the at least two telescoping sections has a relatively flat top face to enable guitar effects pedals to lay flush on top of the lower level 104. Additionally, the bottom face is flat to help the at least two telescoping sections easily slide together and apart. In some embodiments, support ribs may be attached to, or part of, the bottom face of the lower level 104, wherein the support ribs provide additional structural strength to the lower level 104. In some embodiments, the lower level 104 may be comprised of more than two telescoping sections.

Of the at least two components, the first component may be a first telescoping section 106 having a relatively flat, top face/mounting surface and a relatively flat, bottom face. It can be further comprised of a lip along its front, back, and right edges, and a straight edge for its left edge. Alternatively, in some embodiments, the first telescoping section 106 has a lip along its front, back, and left edges and a straight edge for its right edge. The second component may be a second telescoping section 108 that can have a relatively flat, top face/mounting surface and a relatively flat, bottom face. It can be further comprised of a front and a back lip that match up to the lip along the front and back edges of the first telescoping section 106. Therefore, both the first telescoping section 106 and the second telescoping section 108 can include a lip along the front and back edges, as illustrated in FIG. 2. The second telescoping section 108 can also have a lip along its left edge and a straight edge for its right edge (for example, if the first telescoping section 106 has a lip along its right edge), or it can have a lip along its right edge and a straight edge for its left edge (for example, if the first telescoping section 106 has a lip along its left edge). This configuration enables the second telescoping section 108 to slide into and underneath the first telescoping section 106, creating various sizes of a lower level 104 to the pedalboard 100.

In another embodiment, the bottom surface of the first telescoping section 106 and/or second telescoping section 108 has support tracks near the front and back edges of the pedalboard 100, as illustrated in FIGS. 32-37. The support tracks may operate as structural supports to the pedalboard 100. They may, in addition or alternatively, operate as guides so the at least two telescoping sections line up appropriate in relation to each other. In a specific example, the first telescoping section 106 may have a first support track on its bottom surface near the front edge and a second support track on its bottom surface near the back edge, as illustrated in FIG. 33. Further, the second telescoping section 108 may have a first support track on its bottom surface near the front edge and a second support track on its bottom surface near the back edge, as illustrated in FIG. 33.

The support tracks can be separate components that are attached to the first and/or second telescoping section 106, 108, or they can be extensions of the first and/or second telescoping section 106, 108. As illustrated in FIG. 33, the second telescoping section 108 can fit in the length between the support tracks on the first telescoping section 106 and can slide along either on or between the tracks. Therefore, the support tracks on the first telescoping section 106 can keep the second telescoping section 108 positioned appropriately relative to the first telescoping section 106 to continue to allow the holes in the two telescoping sections 106, 108 to line up with each other. Therefore, in this embodiment, the second telescoping section 108 may have a shorter overall length from its front edge to its back edge than the first telescoping section 106, as illustrated in FIG. 32. However, the support tracks may be configured to allow the second telescoping section 108 to retain a similar length from its front edge to its back edge compared to the first telescoping section 106. In an embodiment of the pedalboard 100 having support tracks, the front, back, right, and left edges of the first telescoping section 106 and the second telescoping section 108 may or may not have lips.

Figure 22:
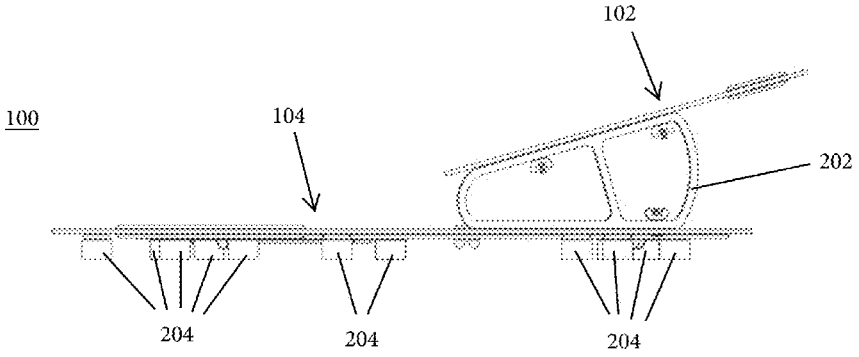
FIG. 22 is a right side elevational view of the adjustable guitar effects pedalboard of FIG. 19 in a closed configuration according to one embodiment of the disclosed device.

In a preferred embodiment, the edges of the first and second telescoping sections 106, 108 are all straight with no lips and there are no support tracks, as illustrated in FIGS. 20-22. By simplifying the design and removing lips and support tracks, the pedalboard 100 can be lighter and, therefore, easier to transport. It also enables the first telescoping section 106 and the second telescoping section 108 to have the same overall length from their front edges to their back edges, although, in some embodiments, the second telescoping section 108 may have a different length (shorter or longer) from its front edge to its back edge than the first telescoping section 106.

In some embodiments, the lower level 104 can be configured and locked into three positions: a closed position, as illustrated in FIGS. 12-13 and 19-24, that can hold eight to ten guitar effects pedals; a partially-expanded position, as illustrated in FIGS. 1-11, 25-27, and 32-37, that can hold ten to fifteen guitar effects pedals; and a fully expanded position, as illustrated in FIGS. 14-17 and 28-31, that can hold fifteen to twenty guitar effects pedals. Additionally, in some embodiments, the at least two telescoping sections of the lower level 104 can be used separately. For example, a user can use the first telescoping section 106 on its own and, if the user decides he or she wants to add on the second telescoping section 108, the user can slide it into, and attach it to, the first telescoping section 106 and use the two telescoping sections in combination. In some embodiments, the lower level 104 can expand to enable the pedalboard 100 to have a width between approximately 26 inches and 42 inches.

Similarly, the upper level 102, in some embodiments, can be separated from the lower level 104, and both levels can be used on their own. Because of this ability to operate as separate pieces, the upper level 102 can also be attached via the risers 202 to various locations along the lower level 104. For example, one embodiment of the disclosed pedalboard 100 can create nine different configurations, wherein the pedalboard 100 has three width options for the lower level 104, as described above (closed, partially-expanded, and fully expanded), and up to four positions for the upper level 102. More specifically, for the closed configuration of the lower level 104, the upper level 102 can fit into two positions, for the partially-expanded configuration of the lower level 104, the upper level 102 can fit into three positions, and for the fully expanded configuration of the lower level 104, the upper level 102 can fit into four positions.

Figure 8:
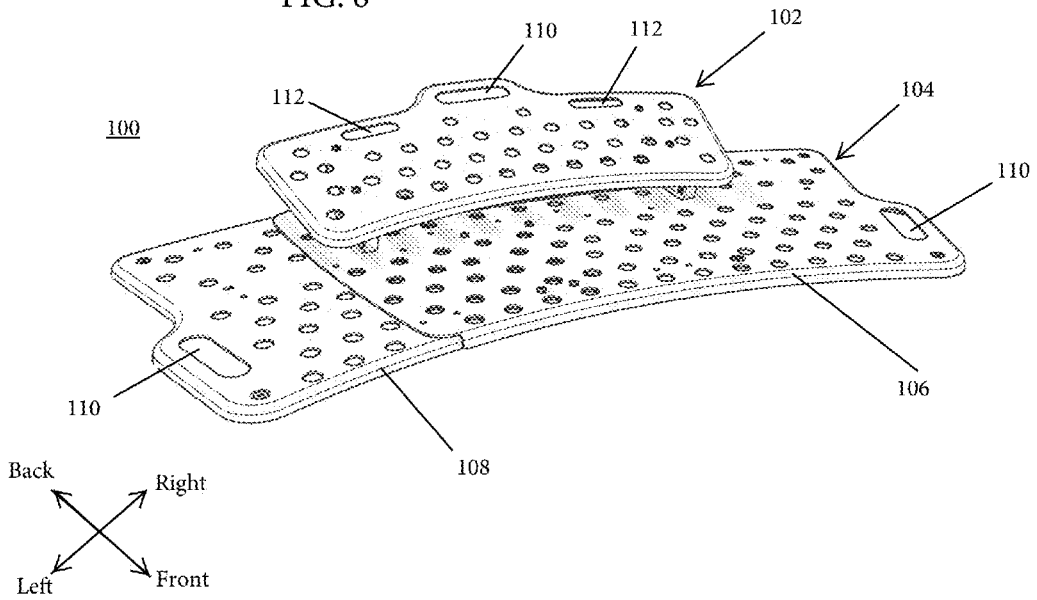
FIG. 8 is a front left side perspective view of the adjustable guitar effects pedalboard of FIG. 1 in a partially expanded configuration according to one embodiment of the disclosed device.
Figure 10:
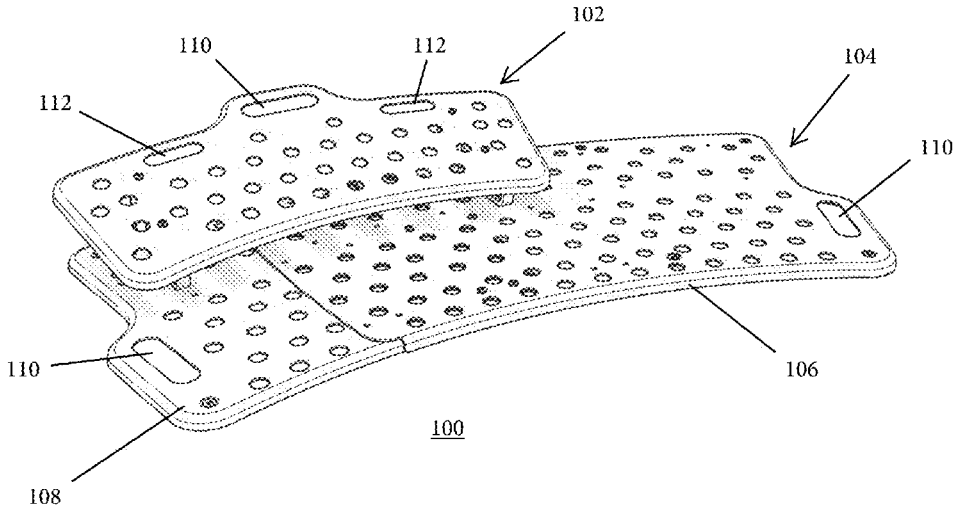
FIG. 10 is a front left side perspective view of an adjustable guitar effects pedalboard in a partially expanded configuration according to one embodiment of the disclosed device.
Figure 11:
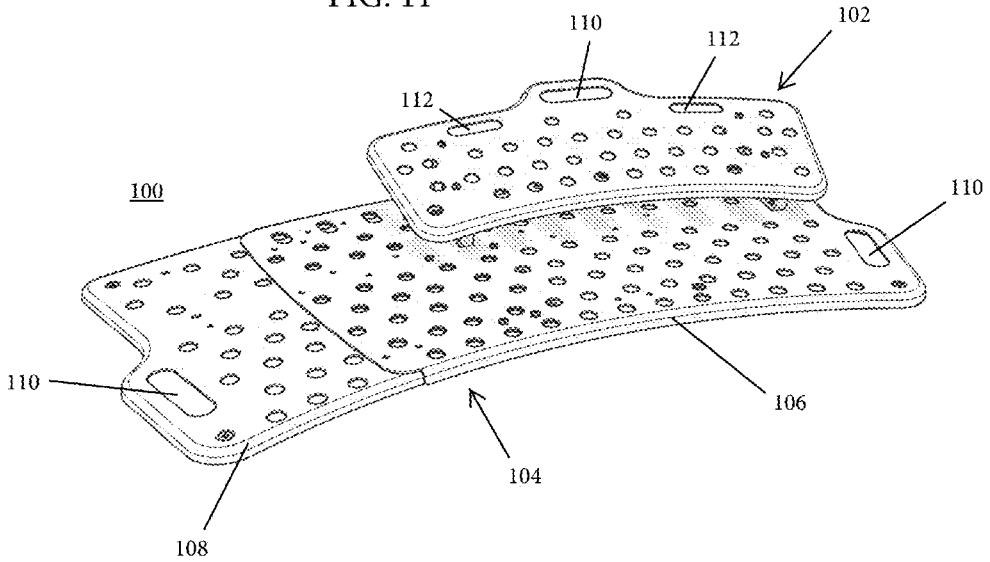
FIG. 11 is a front left side perspective view of an adjustable guitar effects pedalboard in a partially expanded configuration according to one embodiment of the disclosed device.
Figure 12:
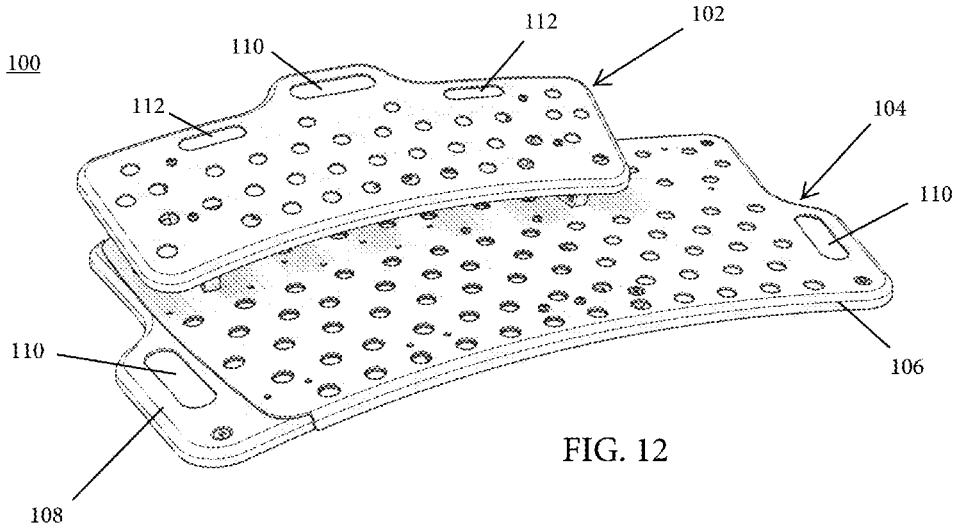
FIG. 12 is a front left side perspective view of the adjustable guitar effects pedalboard of FIG. 1 in a closed configuration according to one embodiment of the disclosed device.
Figure 13:
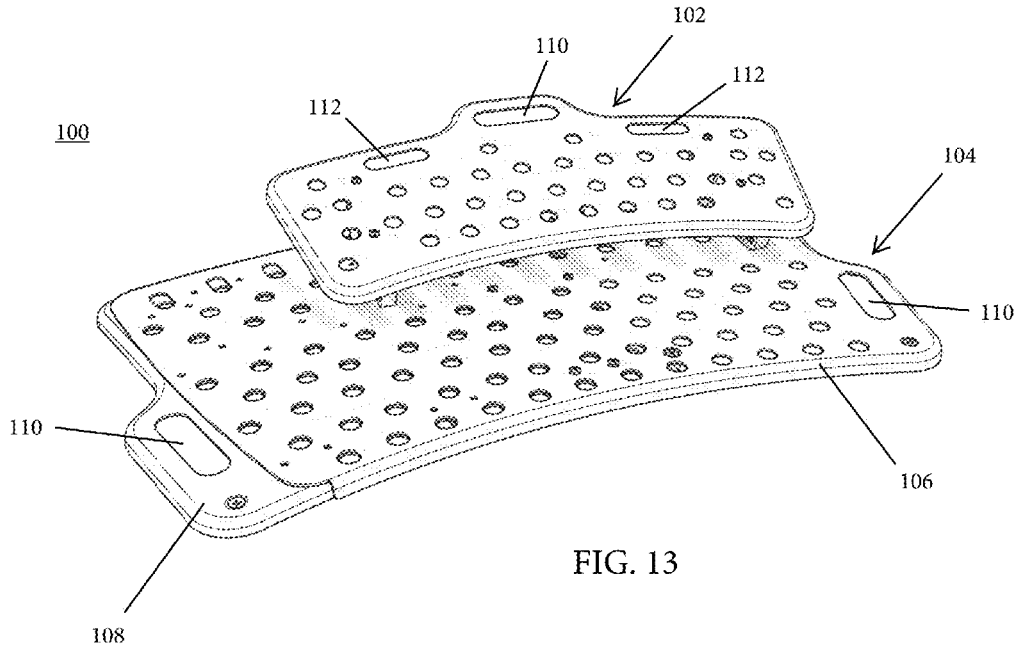
FIG. 13 is a front left side perspective view of the adjustable guitar effects pedalboard of FIG. 11 in a closed configuration according to one embodiment of the disclosed device.
Figure 14:
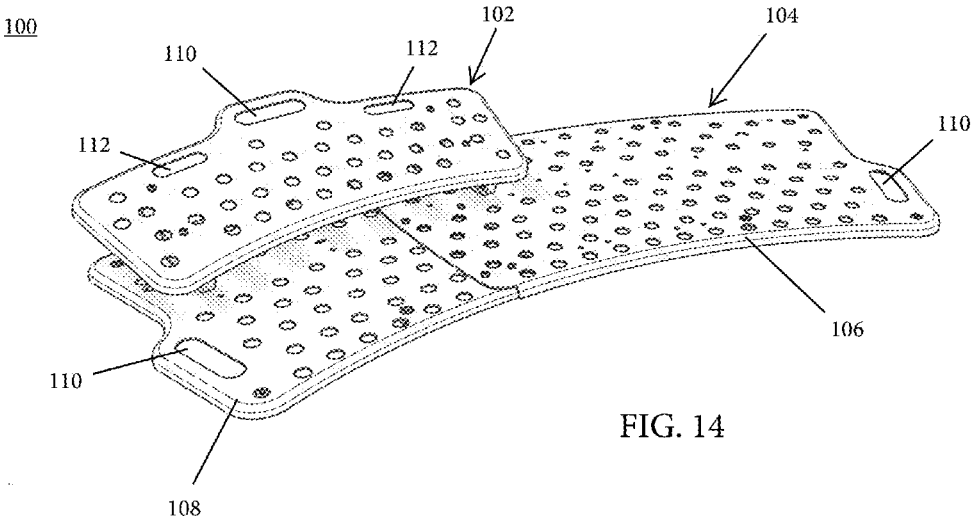
FIG. 14 is a front left side perspective view of an adjustable guitar effects pedalboard in a fully expanded configuration according to one embodiment of the disclosed device.
Figure 15:
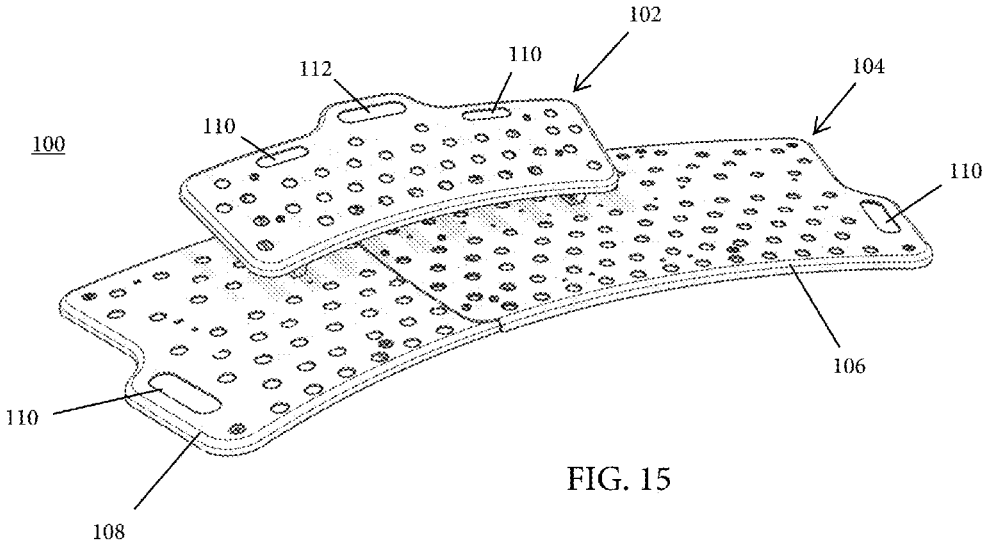
FIG. 15 is a front left side perspective view of the adjustable guitar effects pedalboard of FIG. 10 in a fully expanded configuration according to one embodiment of the disclosed device.
Figure 16:
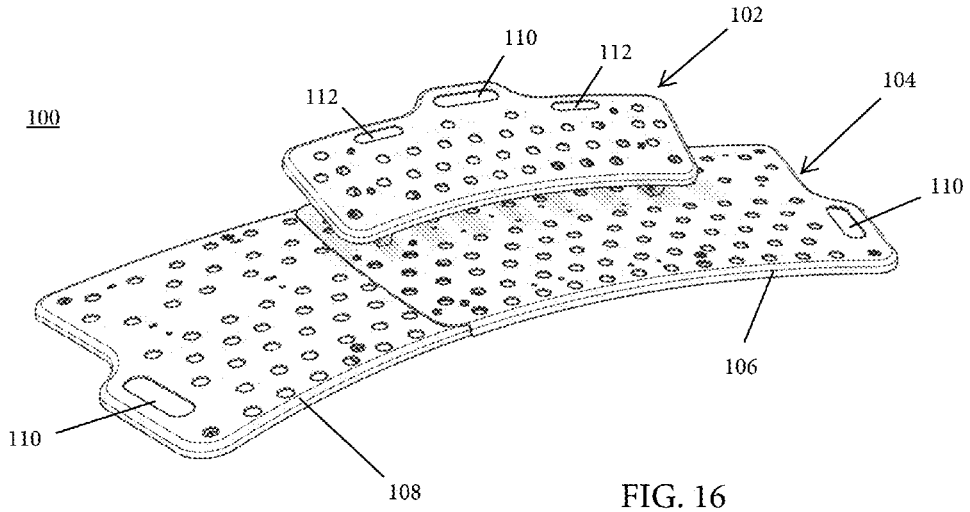
FIG. 16 is a front left side perspective view of the adjustable guitar effects pedalboard of FIG. 1 in a fully expanded configuration according to one embodiment of the disclosed device.
Figure 17:
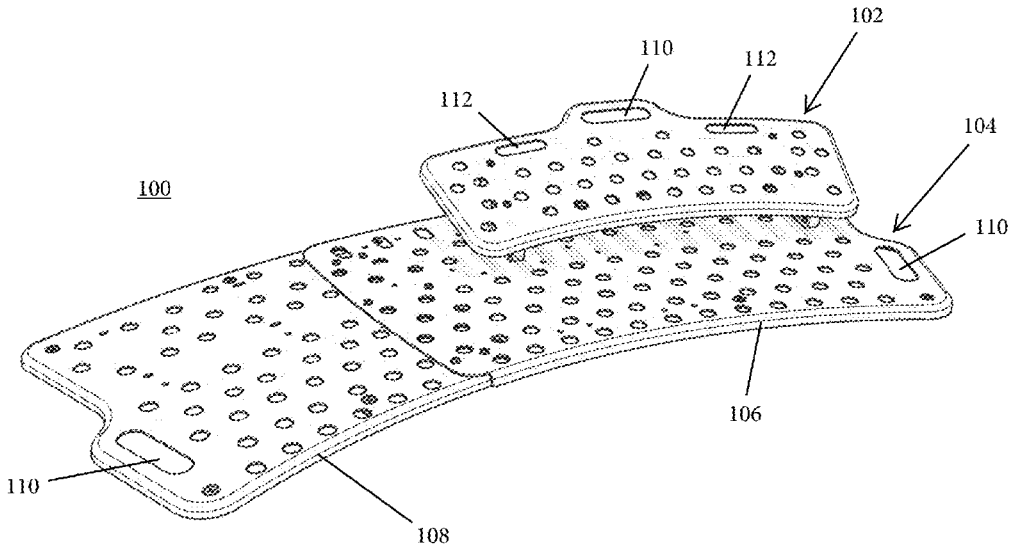
FIG. 17 is a front left side perspective view of the adjustable guitar effects pedalboard of FIG. 11 in a fully expanded configuration according to one embodiment of the disclosed device.
Figure 23:
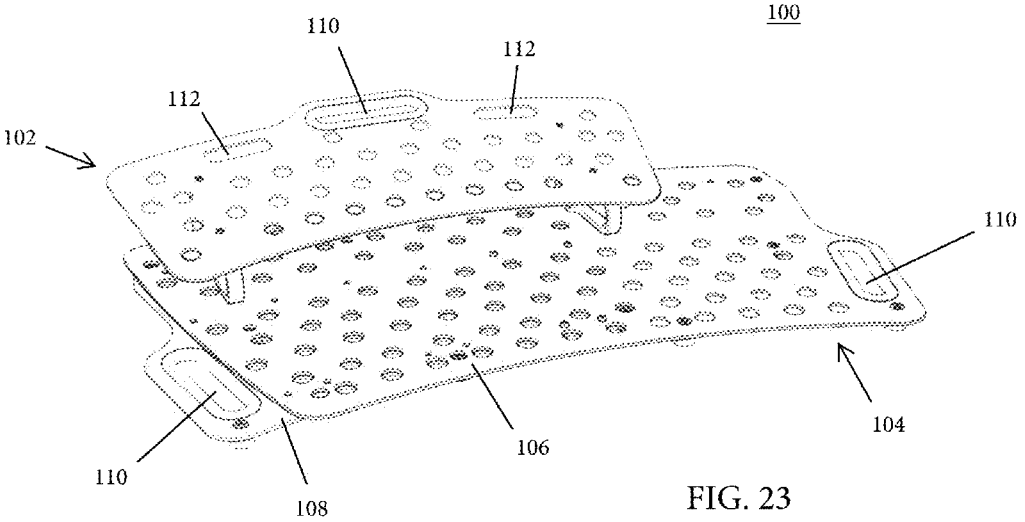
FIG. 23 is a front left side perspective view of the adjustable guitar effects pedalboard of FIG. 19 in a closed configuration according to one embodiment of the disclosed device.
Figure 24:
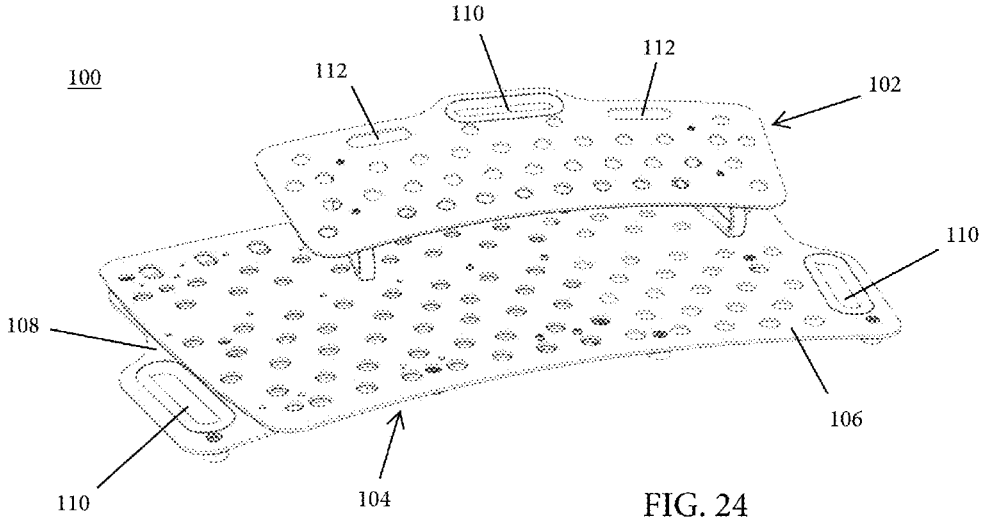
FIG. 24 is a front left side perspective view of an adjustable guitar effects pedalboard in a closed configuration according to one embodiment of the disclosed device.
Figure 25:
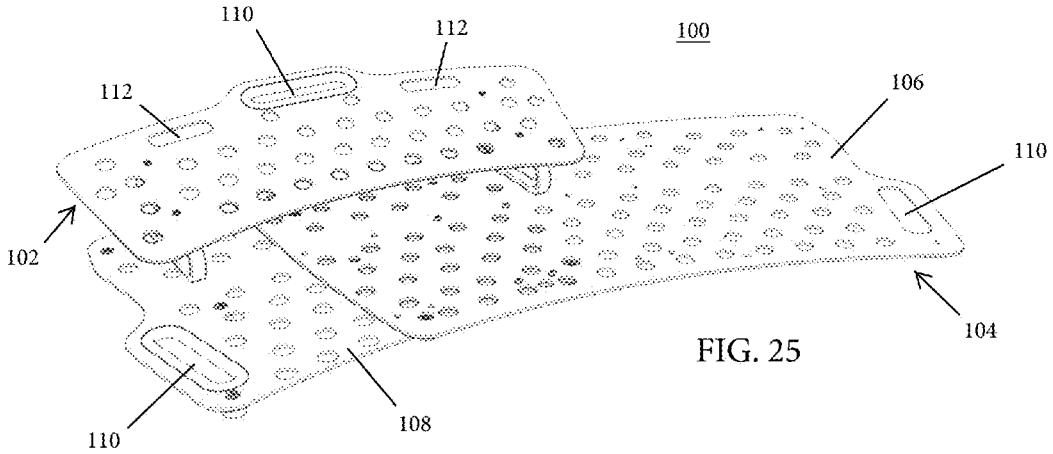
FIG. 25 is a front left side perspective view of an adjustable guitar effects pedalboard in a partially expanded configuration according to one embodiment of the disclosed device.
Figure 26:
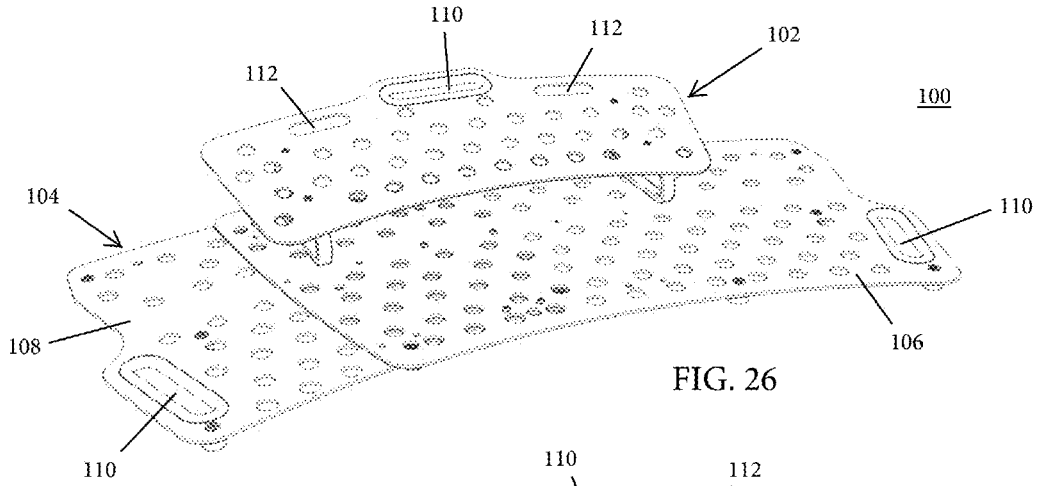
FIG. 26 is a front left side perspective view of the adjustable guitar effects pedalboard of FIG. 19 in a partially expanded configuration according to one embodiment of the disclosed device.
Figure 27:
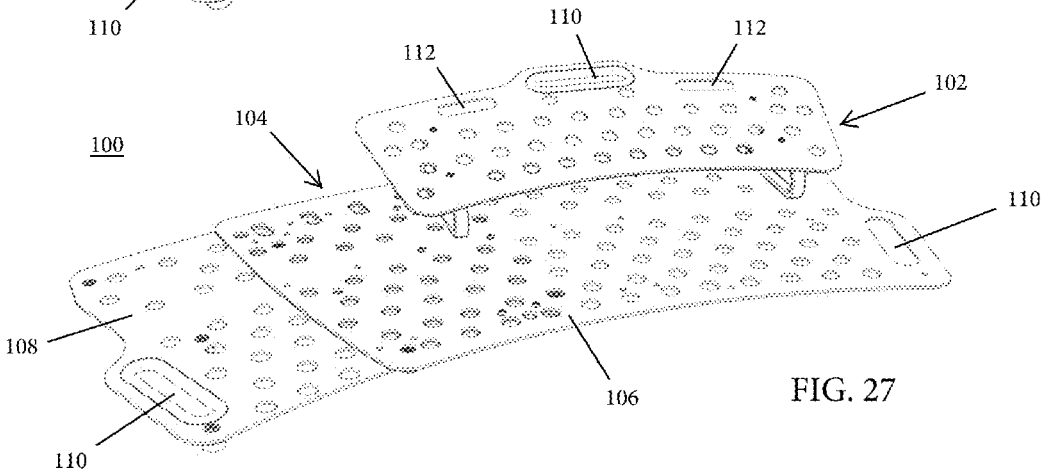
FIG. 27 is a front left side perspective view of the adjustable guitar effects pedalboard of FIG. 24 in a partially expanded configuration according to one embodiment of the disclosed device.
Figure 28:
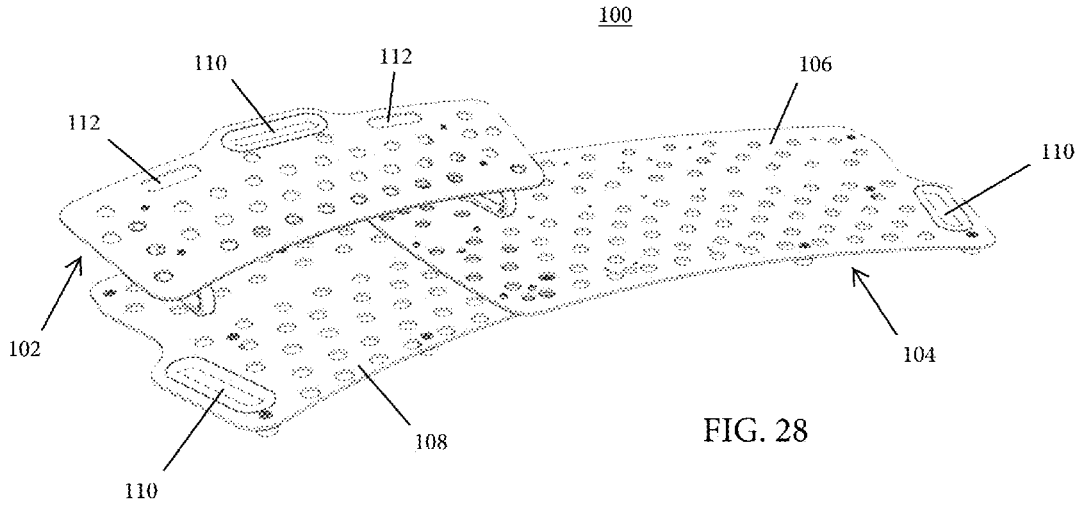
FIG. 28 is a front left side perspective view of an adjustable guitar effects pedalboard in an expanded configuration according to one embodiment of the disclosed device.
Figure 29:
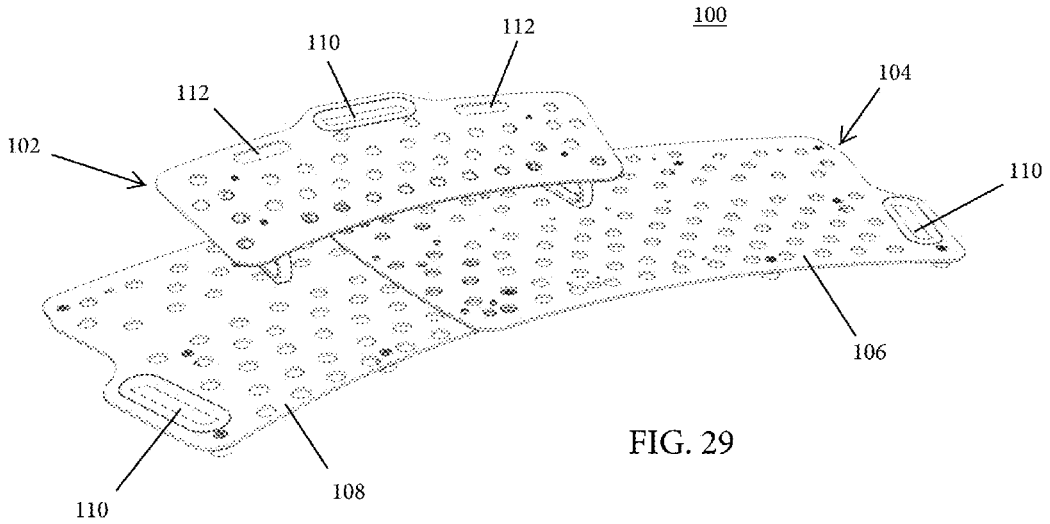
FIG. 29 is a front left side perspective view of the adjustable guitar effects pedalboard of FIG. 25 in an expanded configuration according to one embodiment of the disclosed device.
Figure 30:
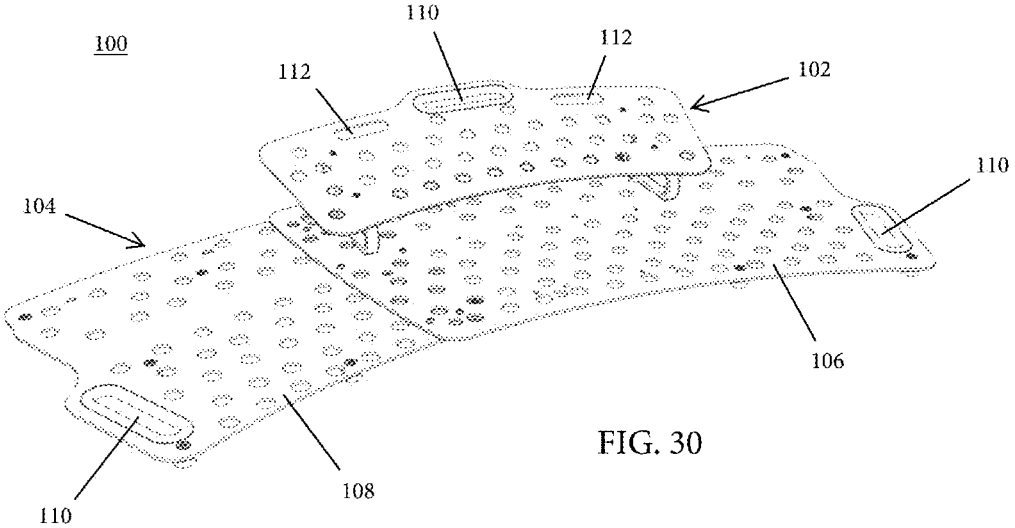
FIG. 30 is a front left side perspective view of the adjustable guitar effects pedalboard of FIG. 19 in an expanded configuration according to one embodiment of the disclosed device.
Figure 31:
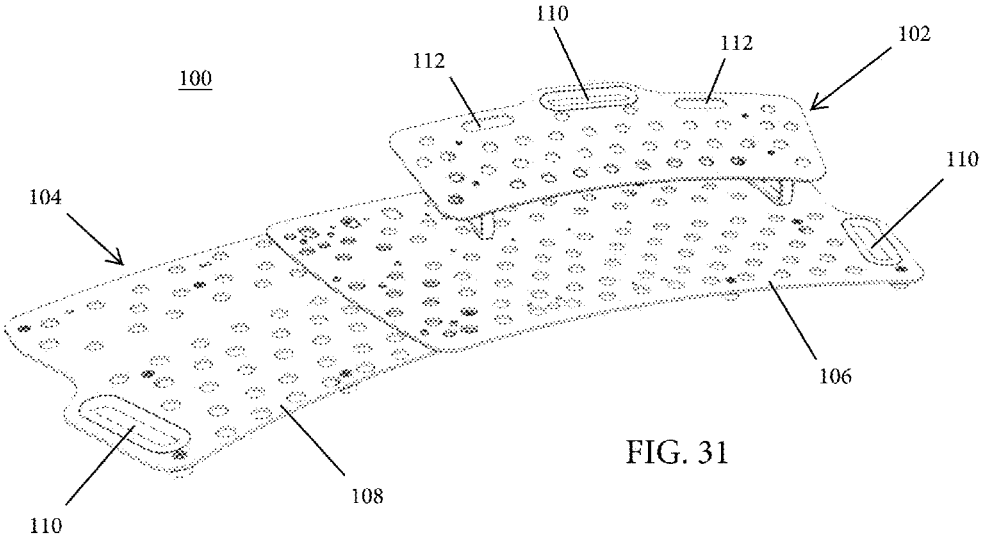
FIG. 31 is a front left side perspective view of the adjustable guitar effects pedalboard of FIG. 24 in an expanded configuration according to one embodiment of the disclosed device.
Figure 37:
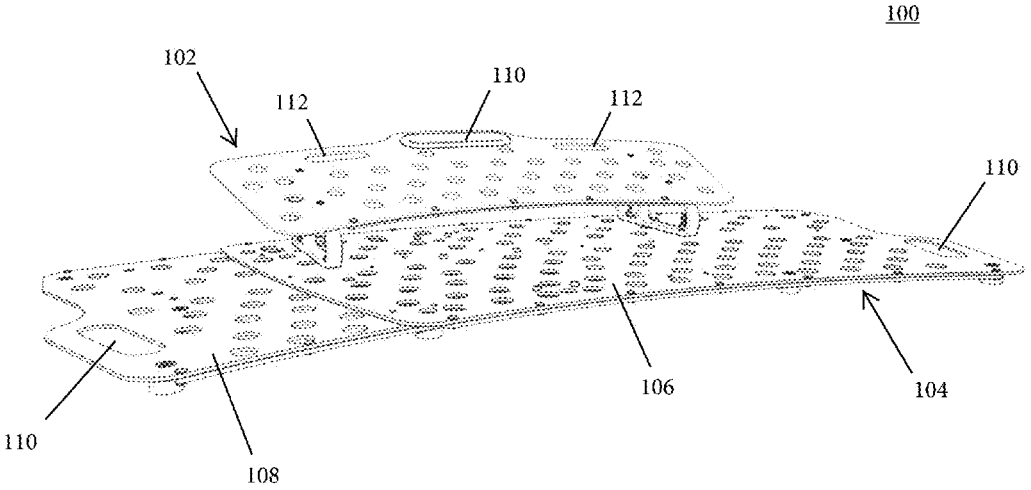
FIG. 37 is a front left side perspective view of the adjustable guitar effects pedalboard of FIG. 32 in a partially expanded configuration according to one embodiment of the disclosed device.

For example, FIGS. 12 and 23 illustrate the pedalboard 100 in a closed configuration with the upper level 102 in the middle right position. FIGS. 13 and 24 illustrate the pedalboard 100 in a closed configuration with the upper level 102 in the far right position. FIGS. 10 and 25 illustrate the pedalboard 100 in a partially expanded configuration with the upper level 102 in the middle left position. FIGS. 8, 26, and 37 illustrate the pedalboard 100 in a partially expanded configuration with the upper level 102 in the middle right position. FIGS. 11 and 27 illustrate the pedalboard 100 in a partially expanded configuration with the upper level 102 in the far right position. FIGS. 14 and 28 illustrate the pedalboard 100 in the fully expanded configuration with the upper level 102 in the far left position. FIGS. 15 and 29 illustrate the pedalboard 100 in the fully expanded configuration with the upper level 102 in the middle left position. FIGS. 16 and 30 illustrate the pedalboard 100 in the fully expanded configuration with the upper level 102 in the middle right position. FIGS. 16 and 31 illustrate the pedalboard 100 in the fully expanded configuration with the upper level 102 in the far right position.

As stated above, in a preferred embodiment, the lower level 104 has a telescoping feature that can increase or decrease the surface area to which the user can attach guitar effects pedals by allowing at least two telescoping sections to move along each other and overlock or interlock in various positions. More specifically, the second telescoping section 108 can slide along or into and out of the first telescoping section 106 to decrease and increase the width of the pedalboard 100. For example, the at least two telescoping sections may slidably connect, wherein a first telescoping section slides over a second telescoping section. Alternatively, the at least two telescoping sections may slidably connect, wherein a first telescoping section slides into a second telescoping section. In another example, the at least two telescoping sections may not slide along or into and out of each other, but may separate from each other to re-align in a new configuration. Therefore, there are several ways in which the lower level 104 can telescope and lock together, additional examples of which are described below.

In some embodiments, the mechanism by which the lower level 104 adjusts is a ratcheted locking mechanism. For example, the mechanism can be similar to a storm window, wherein when the second telescoping section 108 slides into a specific position, a latch on the second telescoping section 108 can slide into a notch on the first telescoping section 106. To expand the second telescoping section 108 out further or to contract it back in, the user can pull the latch out of the notch and move the two pieces further apart or closer together.

In another embodiment, the at least two telescoping sections may not have notches or latches and may instead slide smoothly across each other. In this embodiment, the first telescoping section 106 and the second telescoping section 108, when in a desired configuration, can be secured in a relative position to each other using screws. For example, as illustrated in FIG. 18, screws can attach the upper level 102 to the risers 202 and can attach the risers 202 to the lower level 104.

In some embodiments, when the screws are tightened, the two pieces of the lower level 104, the first telescoping section 106 and the second telescoping section 108, can be secured in place. In another embodiment, there exist screws for the expansion feature that operate independently from the screws attaching the risers 202 to the upper level 102 and the lower level 104. Therefore, a user can loosen the expansion screws and change the expansion configuration without unscrewing the risers 202 from the upper level 102 or the lower level 104. Similarly, a user can unscrew the risers' screws and move the risers 202 and the upper level 102 without affecting the expansion configuration of the lower level 104. In some embodiments, the first telescoping section 106 and the second telescoping section 108 may contain enough friction wherein a user can merely slide them together and apart and they will stay in place once moved into a desired position.

In a preferred embodiment, the at least two telescoping sections are held together using screws. Therefore, to adjust the width of the pedalboard 100, the screws are loosened and removed, the at least two telescoping sections are separated from their original configuration and re-aligned into a new configuration, and the at least two telescoping sections are locked into their new configuration by replacing and tightening the screws. Since the new configuration results in a different width compared to the original configuration, the location of the screws relative to their original location will likely be new as well. This embodiment does not require sliding of the at least two telescoping sections and, in some embodiments, the screws may only have to be loosened, but not removed.

As mentioned above, while expanding and/or contracting, the at least two telescoping sections may use guides, such as lips along the edges or support tracks on the bottom faces, to keep the front and back edges from drifting out of position. In other embodiments, the bottom faces of the at least two telescoping sections are completely flat and it is up the user to ensure the sections line up appropriately before locking them in place.

Importantly, regardless of which configuration the lower level 104 takes, at least some of the holes in the first telescoping section 106 can line up with at least some of the holes in the second telescoping section 108. This ensures that the solid areas on the second telescoping section 108 do not block the holes on the first telescoping section 106 and that the solid areas on the first telescoping section 106 do not block the holes on the second telescoping section 108. This alignment occurs even in the preferred configuration of the pedalboard 100, wherein it is curved and expands on an arc.

In addition to the holes used to secure effects pedals to the pedalboard 100, the pedalboard 100 can also contain larger, oblong holes to be used as handles 110 or as an easy way to hide straps or cords by enabling a person to thread the straps or cords through the holes and under the pedalboard 100. In some embodiments, as illustrated in FIGS. 19-31, some or all of the handles 110 are padded to provide comfort to a user who is carrying the pedalboard 100. FIGS. 1, 19, and 32 illustrate three handles 110 that make it easier for a user to carry the pedalboard 100: one centered on the top face of the upper level 102 near the back edge, one on the top face and near the lower left edge of the lower level 104, and one on the top face and near the lower right edge of the lower level 104. The handles 110 can be located anywhere on the pedalboard 100, but are preferably on the top faces near the edges.

Additionally, in some embodiments, the handles 110 may be protrusions from the pedalboard 100 instead of oblong holes. In some embodiments, the pedalboard 100 also contains two cord holes 112 through which a user can route cords to keep them out of the user's way. These cord holes 112 can be any shape, such as oval, as illustrated in FIGS. 1, 19, and 32, circular, rectangular, square, or any other variety of shapes, and they can be located at any location on the pedalboard. For example, there may be two cord holes 112, wherein each is located on the top face of the upper level 102 near the back edge, with a first on the right side of the handle 110 and a second on the left side of the handle 110, as illustrated in FIGS. 1, 19, and 32. In other embodiments, the cord hole or holes 112 may be located on the lower level 104.

In an alternative embodiment, the top faces of the at least two telescoping sections of the pedalboard 100 may, in a closed configuration, line up next to each other instead of overlapping with each other. Therefore, to expand the width of the pedalboard 100, a user can pull the two components away from each other creating space in between them. Within this space, there may be components such as bars, rails, or supports to which a user can directly attach guitar effects pedals. Alternatively, a third component, such as an insert, may fit in the space between the two telescoping components and attach to the bars, rails, or supports. In that case, guitar effects pedals may then attach to the insert.

In some embodiments, the pedalboard 100 can incorporate lights along the top face, bottom face, or any of the front, back, or side edges. The lights can be steady lights or can flash at regular or irregular intervals. In some embodiments, the lights can flash in time to the beat of the song the user is playing.

To carry the pedalboard 100, a matching bag or soft case may be used. The bag can resemble a messenger bag and can be adjustable in size to reflect the size of the user's pedalboard 100. For example, if a user has adjusted the pedalboard 100 to its smallest size, the user will not want the pedalboard 100 shifting around in the bag banging into additional items in the bag. Therefore, the user can shrink the size of the bag to create a snug fit. Alternatively, if the user has adjusted the pedalboard 100 to its biggest size, the user is going to need a bag that is big enough to fit the pedalboard 100 and can, thus, expand the bag to create the necessary space.

The mechanism used to change the size of the bag can, in some embodiments, be comprised of snaps and folding compartments. Therefore, to make the bag smaller, the user can fold a portion of the bag and snap it in place. Alternatively, straps could be used to hold the folded section in place. In another embodiment, the bag will not fold, but will have air pockets. Therefore, if a user needs to make the inside of the bag smaller, the user can put air into the pockets and the pockets will take up the extra space in the bag. If the user needs to make the bag bigger, the user can easily let air out.

Instead of using a bag, the pedalboard 100 may include a hinge in the middle and handles 110 on the outsides. The hinge may enable the pedalboard 100 to fold so the top face folds in on itself or so the bottom face folds in on itself In the case of the pedalboard 100 folding so the bottom face folds on itself, a user can remove the pedals by releasing the securing mechanism (i.e., cutting the cable ties, rubber bands, twist ties, etc.). In either case, the user can fold up the board along the hinges, and can use the handles 110, which preferably align with each other when the pedalboard 100 is folded, to easily carry the pedalboard 100. In some embodiments, a locking mechanism may be included so the board does not unfold accidentally during transit.

What is claimed is:

1. A guitar effects pedalboard comprising:

at least two telescoping sections that are adjustably connected to each other to enable a variable width of the guitar effects pedalboard; and a plurality of feet attached to a bottom of at least one of the at least two telescoping sections and configured to position the at least two telescoping sections off of the ground;

wherein the at least two telescoping sections have a flat top mounting surface, a bottom surface, a front edge, a back edge, a left edge, and a right edge.

2. The guitar effects pedalboard of claim 1, further comprising:

an upper level located above the at least two telescoping sections, the upper level having a substantially flat top mounting surface, a bottom surface, a front edge, a back edge, a left edge, and a right edge; and at least one riser securing the upper level to the at least two telescoping sections.

3. The guitar effects pedalboard of claim 2, wherein the upper level is removable.

4. The guitar effects pedalboard of claim 2, wherein the upper level is curved.

5. The guitar effects pedalboard of claim 2, further comprising at least one handle.

6. The guitar effects pedalboard of claim 5, wherein the at least one handle is centrally located near the back edge of the upper level.

7. The guitar effects pedalboard of claim 2, wherein the at least one riser connects to the flat top mounting surface of at least one of the at least two telescoping sections and connects to the bottom surface of the upper level.

8. The guitar effects pedalboard of claim 7, wherein the at least one riser has a front and a back, and the back of the at least one riser is taller than the front of the at least one riser.

9. The guitar effects pedalboard of claim 2, wherein the upper level and the at least two telescoping sections comprise metal.

10. The guitar effects pedalboard of claim 2, wherein the upper level is configured to telescope.

11. The guitar effects pedalboard of claim 2, wherein the upper level defines a plurality of holes.

12. The guitar effects pedalboard of claim 1, further comprising at least one handle located near the left or right edge of the at least two telescoping sections.

13. The guitar effects pedalboard of claim 12, further comprising a second handle located near the right or left edge of the at least two telescoping sections.

14. The guitar effects pedalboard of claim 1, wherein:

the at least two telescoping sections include a first telescoping section and a second telescoping section;

the first telescoping section and the second telescoping section each define a plurality of holes; and in at least one width of the variable widths of the guitar effects pedalboard, at least one of the plurality of holes in the first telescoping section and at least one of the plurality of holes in the second telescoping section are configured to line up with each other.

15. The guitar effects pedalboard of claim 1, wherein the plurality of feet position the at least two telescoping sections off of the ground at a height not greater than a thickness of the at least two telescoping sections.

16. The guitar effects pedalboard of claim 1, wherein the at least two telescoping sections are curved and expand on an arc.

17. The guitar effects pedalboard of claim 1, further comprising a first support track at the bottom surface of the first telescoping section near the front edge and a second support track at the bottom surface of the first telescoping section near the back edge, wherein the second telescoping section fits between the first and the second support tracks.

18. The guitar effects pedalboard of claim 1, wherein the at least two telescoping sections include a locking mechanism to lock a first telescoping section and a second telescoping section in place relative to each other.

19. The guitar effects pedalboard of claim 18, wherein the locking mechanism provides a plurality of locking positions.

20. The guitar effects pedalboard of claim 1, wherein the at least two telescoping sections are slidably connected to each other.

* * * * *